US005115623A

United States Patent [19]

Ahlberg

[11] Patent Number: 5,115,623

[45] Date of Patent: May 26, 1992

[54] DISPLAY SYSTEM

[75] Inventor: Erik Ahlberg, Stockholm, Sweden

[73] Assignee: ODC Exhibit Systems Ltd., British Columbia, Canada

[21] Appl. No.: 543,743

[22] PCT Filed: Jan. 27, 1989

[86] PCT No.: PCT/SE89/00026

§ 371 Date: Jul. 12, 1990

§ 102(e) Date: Jul. 12, 1990

[87] PCT Pub. No.: WO89/07307

PCT Pub. Date: Aug. 10, 1989

[51] Int. Cl.[5] ..... E04H 12/18; G09F 15/00

[52] U.S. Cl. ..... 52/646; 52/109; 40/610; 403/171; 403/176

[58] Field of Search ..... 52/645, 646, 109; 40/605, 610; 403/170, 171, 176, 217; 248/166, 432

[56] References Cited

U.S. PATENT DOCUMENTS

| | | | |
|---|---|---|---|
| 4,090,798 | 5/1978 | Barton | 403/171 |
| 4,276,726 | 7/1981 | Derus | 52/109 |
| 4,522,008 | 6/1985 | Zeigler | 52/109 X |
| 4,557,097 | 12/1985 | Mikulas, Jr. et al. | 403/171 X |
| 4,637,153 | 1/1987 | Kane et al. | 40/605 |
| 4,761,929 | 8/1988 | Zeigler | 52/646 |
| 4,942,686 | 7/1990 | Kenemy | 40/610 |
| 4,986,016 | 1/1991 | Wichman | 52/109 |
| 4,995,212 | 2/1991 | Morgan et al. | 52/645 |

FOREIGN PATENT DOCUMENTS

| | | | |
|---|---|---|---|
| 957819 | 11/1974 | Canada | 52/646 |
| 0101805 | 6/1984 | European Pat. Off. . | |
| 1949246 | 4/1971 | Fed. Rep. of Germany . | |
| 2426722 | 12/1975 | Fed. Rep. of Germany . | |
| 1384668 | 11/1964 | France | 52/646 |
| 455239 | 6/1988 | Sweden . | |

*Primary Examiner*—David A. Scherbel
*Assistant Examiner*—Kien Nguyen
*Attorney, Agent, or Firm*—Nixon & Vanderhye

[57] ABSTRACT

A hinged three-dimensional display system primarily intended for advertising and display purposes, is constructed of bars or tubes and connecting pieces, the bars or tubes being pivoted to each other in pairs at their mid-points and forming crossing diagonal struts in the display system, wherein each pair of diagonal bars or tubes is either on a mutually parallel, horizontal plane or on a vertical plane that is at right angles to the former. The system is braced vertically by easily mountable and dismountable struts which are attached on the outside of the display system, on and between adjacent connecting pieces, and on the outward-facing side of which pictures, illustrative material etc. can be attached. Each connecting piece includes a central part having one end provided with four tangentially protruding pivot pins, lying in a single plane and located 90° in relation to each other. The pins are designed to be inserted in holes arranged transversely through the ends of the tubes or bars, whereby the length of the pivot pins somewhat exceeds the thickness of the tubes or the bars so that the bars or tubes can be locked to the pivot pins by means of easily insertable locking devices. The other end of the central part is provided with quick-coupling devices for the fastening of the vertical struts.

16 Claims, 4 Drawing Sheets

DISPLAY SYSTEM

This invention relates to an easy-to-build, hinged three-dimensional display system primarily intended for advertising and display purposes, built of bars or tubes and connecting pieces, whereby the bars or tubes are pivoted to each other in pairs at their mid-points and forming crossing diagonal struts.

Advertising and display systems are previously known from, for example, Swedish patent application 8601109-5, as well as from European patent application 83105864.9, and from U.S. Pat. No. 4,276,726. These previously known display systems are plagued by a number of troublesome disadvantages. One important disadvantage is the fact that the construction of these previously known systems is such that illustration material can be hung on their outer surfaces only. It is therefore not possible in any way to set up, inside the external framework, shelves, etc., for devices such as TV receivers and accompanying video tape recorders, which are an essential part of modern display techniques, and in appropriate cases for exhibits. Additional shelves have so far generally been set outside the display system, which has had the result that the centre of gravity has often been outside the wall itself. Consequently, the system, as described, for example, in EP-A-83105864.9, FIG. 2, must be bent to avoid the risk of tipping. Connecting pieces occurring in these previously known devices are also annoyingly large, and the construction of the entire device becomes very complicated with numerous diagonal pieces.

An object of this invention is to produce a display system which avoids the above-mentioned disadvantages and which is very easy to build, and in the mounted form very easy to fold and unfold, at the same time that its transportation dimensions are very small, whereby the joint pieces are designed so that they have no detrimental effect on the function of the system as a display system. It should also be easy to supplement the system with attachments such as shelves, spotlights etc. at the same time that illustration material should be easy to attach to the display system.

According to the present invention there is provided an easy-to-build, hinged three-dimensional display system primarily intended for advertising and display purposes, constructed of bars or tubes and connecting pieces, the bars or tubes being pivoted to each other in pairs at their mid-points and forming crossing diagonal struts in the display system, wherein each pair of diagonal bars or tubes is either on a mutually parallel, horizontal plane or on a vertical plane that is at right angles to the former. The system is braced vertically by easily mountable and dismountable struts which are attached on the outside of the display system on and between adjacent connecting pieces and on the outward-facing side of which pictures, illustrative material etc. can be attached. Each connecting piece includes a central part, one end of the central part being provided, in an offset, tetraskelian configuration, with four tangentially protruding pivot pins, which are shifted 90° in relation to each other and which are designed to be inserted in holes arranged transversely through the ends of the tubes or bars, whereby the length of the pivot pins somewhat exceeds the thickness of the tubes or the bars, the bars or tubes can be locked to the pivot pins by means of easily insertable locking devices, and the other end of the central part is provided with quick-coupling devices for the fastening of the vertical struts.

The invention will now be described in more detail, by way of example only, with reference to the accompanying drawings in which.

Figure 1:
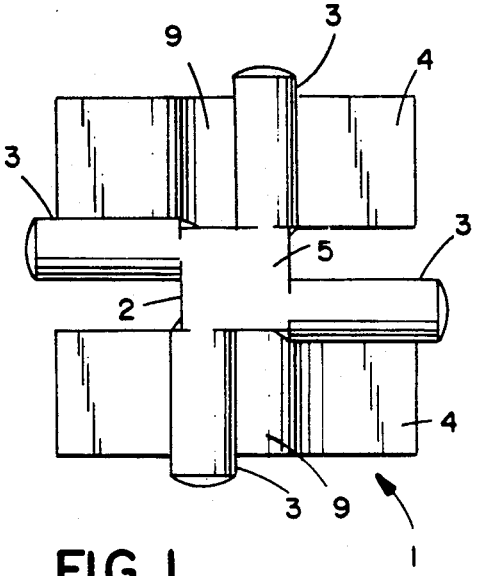
FIG. 1 shows a connecting piece according to the invention seen from the side (in a position of use)

FIG. 1 shows a connecting piece 1 seen from the side, in the position that it is going to have at the time of mounting. The connecting piece is built around a central part 2, which forms a square in cross-section. Connected to one end 5 of the central part 2, pivot pins 3 protrude from all sides connected to the corners of the square in such a way that the edge of a pivot pin basically constitutes a continuation of one side of the square, and thereby forms tetraskelian configuration with regard to the centre of the square cross-section of the central piece. As is seen in the figure, however, the terminal face of the pivot pin should preferably protrude to some extent in relation to the square's near side, which is parallel to the longitudinal axis of the pivot pin. This has the result that the connecting piece can be constructed in extremely small dimensions. At its other end 7, the central part is equipped with two slabs 4 that protrude from two opposing sides of the central part and whose first flat face 6 is on the same level as the other terminal face of the central part.

Figure 2:
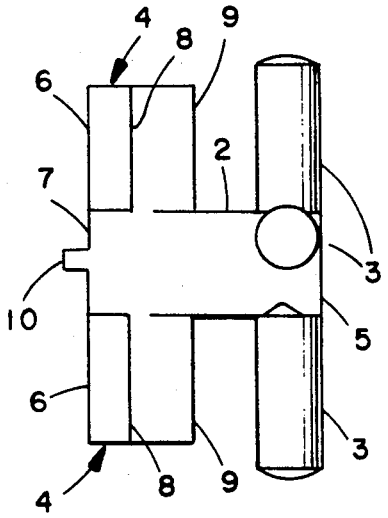
FIG. 2 shows the same connector seen from the side, but turned 90°.

The slabs 4 are equipped with a transverse bead 9 on their other flat side 8 that is turned toward the pivot pins, where the slabs connect to the central part 2. The bead runs into the central part. FIG. 2 again shows the connecting piece from the side but turned 90° in relation to FIG. 1. The other terminal face 7 of the central part is equipped with a stop lug 10.

Figure 3:
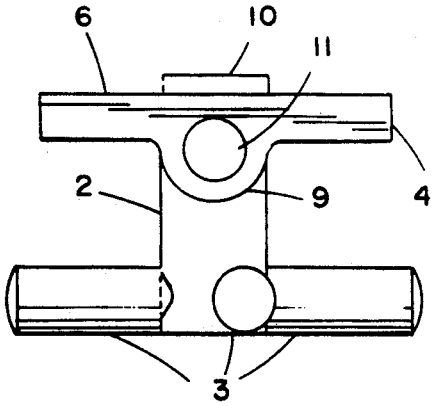
FIG. 3 shows the same connector seen from above.
Figure 4:
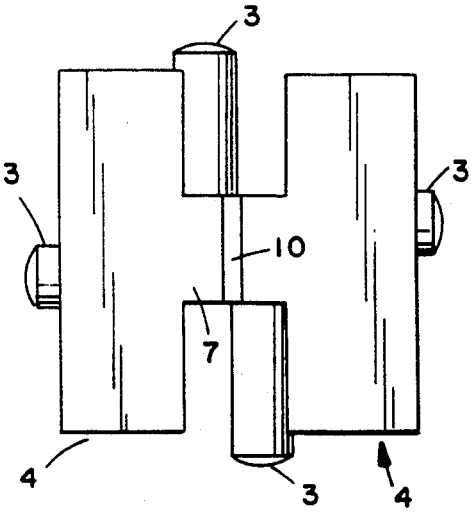
FIG. 4 shows the same connector seen from the third side, turned away from the system.
Figure 5:
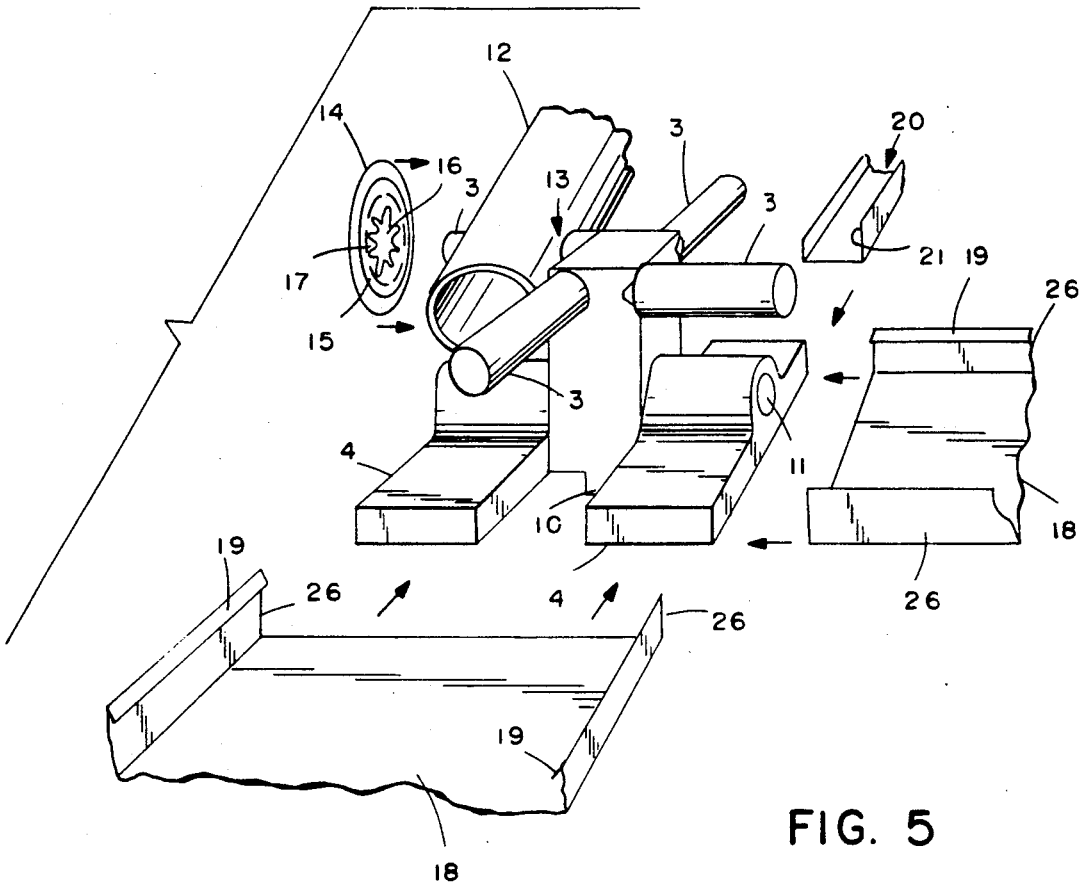
FIG. 5 shows the joint piece in perspective with the basic construction elements that are part of the system.

FIG. 3 shows a connecting piece seen from above, and here we see how beads 9 and the central body 2 are equipped with a through-hole 11 that is normally vertical when in use. FIG. 4 again shows the connector from the side, showing that part of the connecting piece that faces away from the display system. FIG. 5 then shows the additional basic elements of which the display system is built. The tubes or rods 12 that constitute the vertical and horizontal diagonal pairs are thus an integral part of the system. The ends of these rods or tubes 12 are equipped with through holes 13, which conform to the diameter of the pivot pin 3. The rods or tubes 12 are mounted on the pivot pin and locked by means of a locking device 14, in this case a previously-known press-button equipped with a spring washer 15 with a central hole 16 and locking tabs 17.

When the tube 12 has been mounted on the pivot pin 3, the lock washer is simply pushed onto the end of the pivot pin, and the tube 12 is thereby effectively locked against a lateral displacement.

Another integral part of the system comprises wide rails 18 in the form of shallow U-shaped profiles, which are, along their free longitudinal edges 26 equipped with slanting inward and downward turned flanges 19, whose free edges are at a level corresponding to the thickness of the slabs 4. The width of the U-shaped profiles 18 corresponds to the length of the side of the square formed by the combined external outlines of the slabs 4, which means that the rail 18 can simply be pushed over the slabs 4 up to the stop lug 10.

The material of the rails and their thickness is chosen so that the rails can also be pressed at right angles against the terminal faces 6 of the slabs 4 in such a way that the rails with the flanges 19 springily snap onto the slabs 4. There is also a narrower U-shaped rail 20, whose one free edge is equipped with a flange 21. The width of this narrower rail 2 conforms to the corresponding width of an individual slab 4. The rail 20 is also so designed that it can be optionally snapped onto or pushed over a slab 4. The rail 20 is preferably used horizontally on the upper and lower edges of the system.

Figure 6:
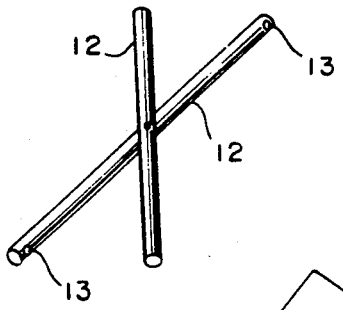
FIG. 6 shows a few of the tubes that are part of the system and that are pivoted to each other at their mid-points.
Figure 7:
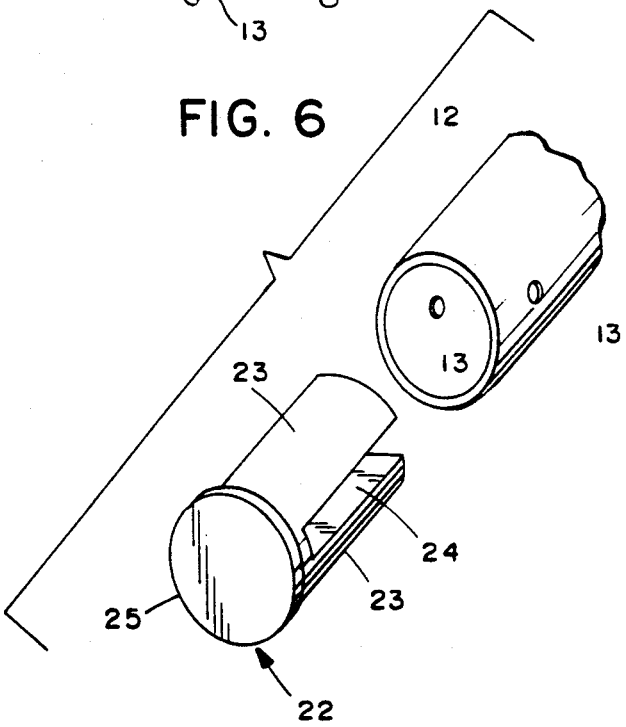
FIG. 7 shows a friction brake that is placed at the end of a tube after the mounting of the system.

FIG. 6 shows a pair of bars or tubes 12 that are pivoted to each other, and the holes 13 placed at the ends of the tubes. FIG. 7 shows a friction brake 22 that consists of two massive semi-cylinders 23, which are separated by a longitudinal gap 24, which is somewhat narrower in width than the thickness of a pivot pin 3.

The semi-cylinders are connected by a terminal piece 25. The diameter essentially corresponds to the inner diameter of a tube 12. When the tube 12 has been mounted on a connecting piece 1, such a friction brake can he pressed into the end of the tube, whereby the friction in the link between the bar 12 and the connecting piece 1 is essentially increased. This makes the unfolding of the display system easier, as it gives the system certain stability as will be explained in more detail below.

Figure 8:
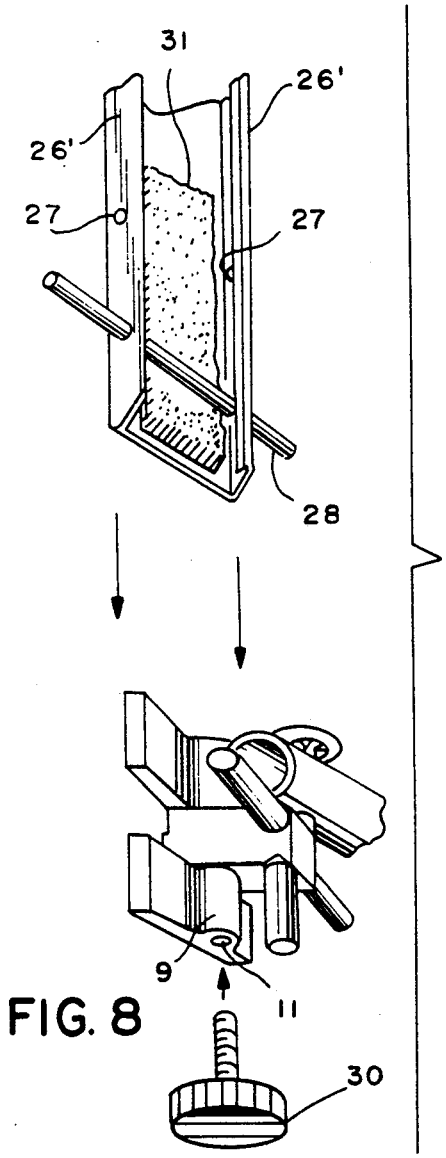
FIG. 8 shows how the vertical rails of the system are formed so that the system can be supplemented with shelves and a height adjustment device to adjust the system to uneven floors.

Lastly, FIG. 8 shows how the vertical through hole 11 can be used to adjust the system to uneven floors, by means of a threaded spacing screw 30. Some, or all, connecting pieces can be made with threads in this manner. Brackets and other support devices can be inserted in the holes 11 for spotlights, etc. As there are holes in each connecting piece, the placing of spotlights or other accessories can take place fairly freely on the face of the entire display system. FIG. 8 also shows how a rail 18' can also be used for the placement of shelves in a compartment of the display system. For this purpose, the free, longitudinal flanges 26' are, along their length, equipped with holes 27 that face each other and through which a transverse pin 28 can be pushed. A shelf can then rest on these transverse pins 28. To prevent the transverse pin 28 from sliding out of the holes in the flanges of the profile, the bottom of the U-shaped profile is equipped with, preferably, an adhesive strip 31 of teazle tape (Velcro tape), pile, weather-stripping of plastic foam or rubber, etc, that increases friction between the transverse pin 28 and the rail 18'.

Figure 9:
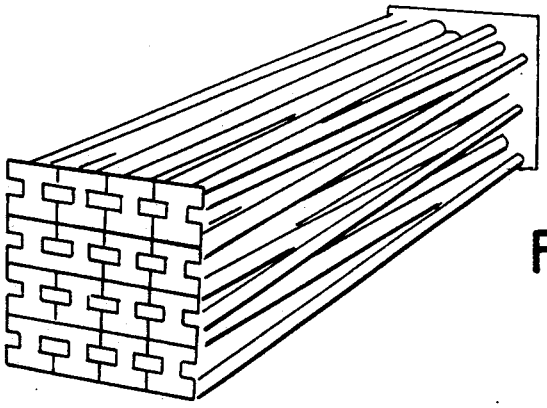
FIG. 9 shows the system in folded form.
Figure 10:
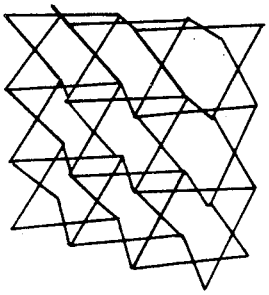
FIG. 10 shows the system in a partially unfolded form.
Figure 11:
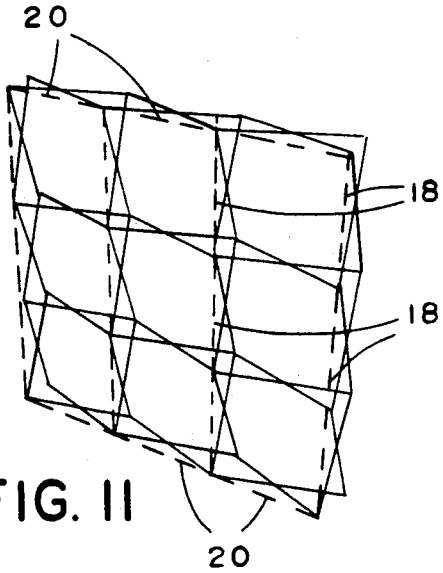
FIG. 11 shows the system in an unfolded form and equipped with vertical and horizontal rails for illustration material etc.

FIGS. 9 to 15 show in more detail how the display system functions and is used. As shown in FIG. 11, the display system consists of a number of compartments that are individually enclosed by two vertical pairs of diagonal rods and two horizontal pairs of diagonal rods. The inside of each compartment is thus quite free. The mounting of the basic structure itself can take place very simply and quickly in that the tubes or rods 12 are, in the joints, attached to a connecting piece 1. As shown in FIG. 11 in particular, four rods or tubes 12 are pivoted in this manner to a given connecting piece, apart from the connecting pieces that are situated on the edges of the frame. As mentioned above, it suffices to thread pivot pins 3 through holes 13 in rods and to lock them with a press-button 14. It should be emphasized that this locking by means of a spring washer is very strong, capable of tolerating a load of up to 100 kg without coming loose, but it is nevertheless easy to release. The basic structure itself, as shown in FIGS. 9 and 10, is accomplished in this way, and it can be folded into a particularly compact package (see FIG. 9) in a similar way as in the case of "Nuremburg scissors". From this position, the whole system can be easily drawn, as shown in FIG. 10, into the position shown in FIG. 11. In this straightened position, the device is simply locked by snapping the vertical rails 18 onto the outward-facing sides 6 of the connecting pieces 1.

Each rail is of a suitable length that corresponds to a compartment, i.e., the distance between two adjacent joints. In the vertical link, the rail 18 is thereby locked by the lug 10 on the terminal face 7 of the central part. It should be pointed out that the system is essentially locked solely with a vertical rail between two near joints, both horizontally and vertically.

The stability of the system naturally increases with the number of verticals. At the top and at the bottom, the narrower rails 20 are suitable for attaching onto the individual slabs 4 horizontally. It is important, just before the vertical rails are snapped on that there is enough inner friction between the tubes 12 and the connecting pieces 1. If there is enough friction, the basic structure can stand by itself without additional measures even on a slippery floor until the structure has been braced by means of the vertical rails.

Figure 12:
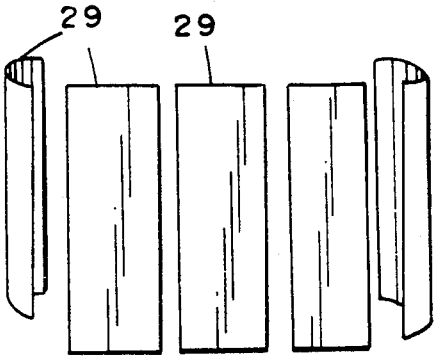
FIG. 12 shows an example of a cover for the display system in sheet form.

The outside of the vertical rails are best equipped with fastening devices, for instance in the form of magnetic tapes the work jointly with corresponding tapes on sheets 29 shown in FIG. 12. The fastening devices can naturally consist of other suitable materials such as teazle tape, adhesive tapes, etc. Systems using magnets are, however, the preferred arrangement because they allow for certain movement in the structure without the sheets coming loose.

The sheets 29 suitably consist of soft, flexible sheets such as ABS plastic, on which the pictures are either affixed or put in one piece with the plastic. The sheets can then be easily rolled up and packed together with the folded basic structure. Due to the construction of the rails, the sheets 29 can lie close to one another without clearly observable junctions, which means that, if desirable, it is possible to use pictures that are continuous and as large as the whole screen. This has not been possible in previously known systems.

Figure 15:
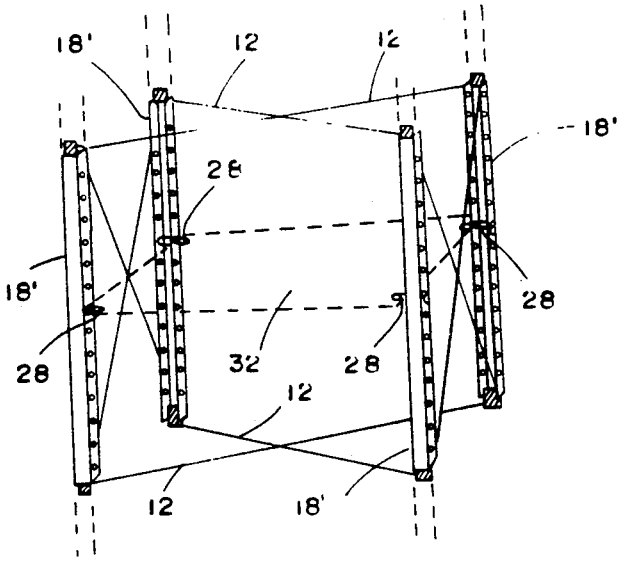
FIG. 15 shows a compartment of the system with a shelf inside it.
Figure 13:
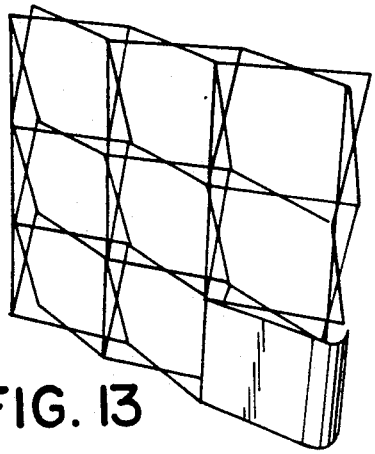
FIG. 13 shows how the sheets of FIG. 12 are placed on the display system.
Figure 14:
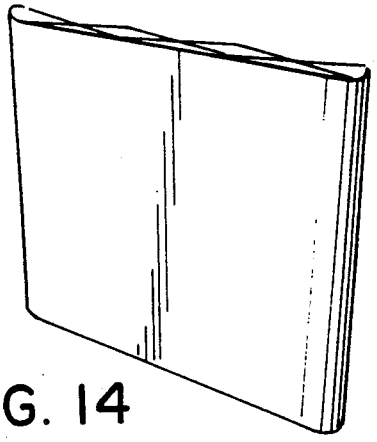
FIG. 14 shows a display system that is completely covered.

FIGS. 13 and 14 show how the frame of the display system is step by step covered with sheets. Lastly, FIG. 15 shows an individual compartment of the display system in which four of the wide rails 18' equipped with holes are used. Four transverse pins 28 have been inserted into the four rails, and a shelf 32 marked in a broken line rests on the pins. As seen in the figure, the centre of gravity of an object located on the shelf will normally fall within the exterior framework of the display system, which is advantageous from the stability point of view.

The invention will thus create a display system that is very easy to transport, that takes very little space in its folded form, that can easily be extended or reduced in size, at the same time that the system is sufficiently stable and rigid for it to be equipped with shelves for TV receivers, exhibits or other relatively heavy objects. The special design of the connecting pieces has the result that they can be made extremely small, which contributes to the fact that the system can have extremely small dimensions in its folded position, which is an essential condition for the system to be easily transportable.

The invention is naturally not limited to the above arrangement but can be modified in many ways within the scope of the claims.

The embodiments of the invention in which an exclusive property or privilege is claimed are defined as follows:

1. A hinged, three dimensional display system comprising a plurality of elongated members, a plurality of struts, and at least one associated connecting piece, said connecting piece including a central part having a longitudinal axis and a first end provided with four pivot pins extending away from said central part in a plane perpendicular to said longitudinal axis, each pin having an axis offset from said longitudinal axis and extending in a direction 90° from an adjacent pin, said central part having a second end provided with at least a pair of coupling members; wherein each of said plurality of elongated members is provided with an aperture for receiving a corresponding one of said pivot pins and wherein one or more of said struts are mountable on a corresponding one or more of said coupling members.

2. A display system as claimed in claim 1 wherein said struts are in the form of rails.

3. A display system as claimed in claim 1 and including a locking device for securing said elongated members on respective ones of said pivot pins.

4. A display system as claimed in claim 3, wherein each locking device is formed as a press-button equipped with a spring washer and provided with a central hole of a smaller diameter than the diameter of the corresponding pivot pin, and slots located radially outward from the central hole of the spring washer, thus forming locking tabs.

5. A display system as claimed in claim 1 wherein said central part has a substantially square cross section and wherein said pivot pins protrude from each corner thereof.

6. A display system as claimed in claim 1 wherein said elongated members comprise tubes co-operating with a friction brake consisting of two semi-cylindrical parts joined by means of a terminal piece and separated by a gap having a width less than the diameter of said pivot pins which friction brake is pushed into the end of a tube so that the part of the pivot pin that is in the tube is inserted into the gap.

7. The display system of claim 1 wherein said plurality of coupling members include a pair of substantially parallel slabs extending along opposite sides of said central part, perpendicular to said longitudinal axis, and wherein a first surface of each slab lies in a plane containing a terminal end face of said central part.

8. A display system as claimed in claim 7, wherein second surfaces of said slabs opposite said first surfaces and which are turned toward said pivot pins, are provided with beads extending across the slabs, with a through-hole extending through both beads and through the central part.

9. A display system as claimed in claim 8, wherein said through-hole is equipped with interior threads to receive a spacing device for adjusting the display system to uneven floors.

10. A display system as claimed in claim 9, wherein said spacing device comprises a threaded spacing screw.

11. A display system of claim 7 wherein said plurality of struts are in the form of rails, at least one of which has a width substantially equal to a width defined by the pair of slabs such that said at least one rail is slidably mounted on first ends of said pair of slabs.

12. A display system of claim 11 wherein at least one other of said struts is also in the form of a rail, but with a width substantially equal to a width defined by one of said slabs such that said at least one other slab is slidably mountable on either of opposite ends of said at least one other slab.

13. A display system of claim 12 wherein each rail has as U-shaped profile including a bottom and a pair of parallel flanges extending longitudinally of the rail, and wherein at least one free edge of one of said parallel flanges is provided with a downwardly and inwardly extending flange, and further wherein a free edge of the flange is located above the bottom of the U-shaped profile a height substantially equal to a thickness of the slabs.

14. A display system as claimed in claim 13 wherein at least one of said rails is provided, in its longitudinal flanges, with holes through which a transverse pin can be inserted to hold shelves, and the bottom of the rail is provided with a strip made of friction material.

15. A display system as claimed in claim 13 wherein sides of said rails facing away from said connecting piece are equipped with longitudinal magnetic tapes adapted to cooperate with magnetic tapes on illustrative material.

16. A display system as claimed in claim 12, wherein said second end of said central part is, at a mid point of said terminal end face, provided with a stop lug that limits shifting movement of said rails relative to said slabs.

* * * * *